US012729478B2

(12) United States Patent
Seo et al.

(10) Patent No.: US 12,729,478 B2
(45) Date of Patent: Sep. 8, 2026

(54) ELECTRONIC DEVICE FOR SHOE OR CLOTHING CARE AND METHOD FOR CONTROLLING OPERATION THEREOF

(71) Applicant: SAMSUNG ELECTRONICS CO., LTD., Suwon-si (KR)

(72) Inventors: Dongpil Seo, Suwon-si (KR); Yonghan Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 1017 days.

(21) Appl. No.: 17/953,644

(22) Filed: Sep. 27, 2022

(65) Prior Publication Data

US 2023/0175192 A1 Jun. 8, 2023

Related U.S. Application Data

(63) Continuation of application No. PCT/KR2022/013290, filed on Sep. 5, 2022.

(30) Foreign Application Priority Data

Dec. 7, 2021 (KR) ..... 10-2021-0173840

(51) Int. Cl.
*D06F 58/10* (2006.01)
*A47L 23/20* (2006.01)
(Continued)

(52) U.S. Cl.
CPC ..... *D06F 58/10* (2013.01); *A47L 23/205* (2013.01); *D06F 58/38* (2020.02);
(Continued)

(58) Field of Classification Search
CPC ..... D06F 58/10; D06F 58/38; D06F 2105/22; D06F 2105/26; D06F 2105/30;
(Continued)

(56) References Cited

U.S. PATENT DOCUMENTS

2021/0017699 A1 1/2021 Kim et al.

FOREIGN PATENT DOCUMENTS

CN 203021820 U 6/2013
CN 212223401 U 12/2020
(Continued)

OTHER PUBLICATIONS

International Search Report dated Dec. 16, 2022 in International Patent Application No. PCT/KR2022/013290.
PCT/ISA/237 dated Dec. 16, 2022 in International Patent Application No. PCT/KR2022/013290.

*Primary Examiner* — Michael G Hoang
*Assistant Examiner* — Bao D Nguyen
(74) *Attorney, Agent, or Firm* — STAAS & HALSEY LLP

(57) ABSTRACT

An electronic device for controlling a flow path according to deodorization, dehumidification, or sterilization of clothes or shoes by applying a separated chamber structure, and an operation method thereof. The electronic device may control an internal damper so that in a deodorization mode, the internal damper operates in a first state to form independent flow paths in an upper chamber and a lower chamber and, in a dehumidification mode, the internal damper operates in a second state for a preset time to form a single flow path in the upper chamber and the lower chamber and, after the preset time elapses, operate in the first state to form independent flow paths in the upper chamber and the lower chamber.

7 Claims, 11 Drawing Sheets

(51) Int. Cl.

| | |
|---|---|
| ***D06F 58/38*** | (2020.01) |
| *D06F 105/22* | (2020.01) |
| *D06F 105/26* | (2020.01) |
| *D06F 105/30* | (2020.01) |

(52) U.S. Cl.
CPC ..... *D06F 2105/22* (2020.02); *D06F 2105/26* (2020.02); *D06F 2105/30* (2020.02)

(58) Field of Classification Search
CPC ..... D06F 58/20; D06F 58/206; D06F 58/45; D06F 73/02; D06F 58/203; D06F 2103/56; A47L 23/205; A47L 23/20; A47B 61/04
USPC ..... 34/390, 571, 209, 210
See application file for complete search history.

(56) References Cited

FOREIGN PATENT DOCUMENTS

| | | | | | |
|---|---|---|---|---|---|
| KR | 20-0206221 | | | 12/2000 | |
| KR | 10-2006-0015903 | | | 2/2006 | |
| KR | 10-2006-0015903 | A | | 2/2006 | |
| KR | 10-0830513 | | | 5/2008 | |
| KR | 10-2009-0037601 | A | | 4/2009 | |
| KR | 20090102401 | A | * | 9/2009 | ..... D06F 73/02 |
| KR | 10-2019-0131258 | | | 11/2019 | |
| KR | 10-2019-0131259 | | | 11/2019 | |
| KR | 10-2020-0096478 | | | 8/2020 | |
| KR | 10-2021-0009694 | | | 1/2021 | |
| KR | 10-2021-0030856 | | | 3/2021 | |
| KR | 10-2021-0083904 | | | 7/2021 | |

* cited by examiner

ELECTRONIC DEVICE FOR SHOE OR CLOTHING CARE AND METHOD FOR CONTROLLING OPERATION THEREOF

CROSS REFERENCE TO RELATED APPLICATION(S)

This application is a continuation application, under 35 U.S.C. § 111(a), of International Application No. PCT/KR2022/013290 designating the United States, filed on Sep. 5, 2022, in the Korean Intellectual Property Receiving Office, which claims priority from Korean Patent Application No. 10-2021-0173840, filed on Dec. 7, 2021, in the Korean Intellectual Property Office, the disclosures of which are hereby incorporated by reference herein in their entireties.

BACKGROUND

Field

The disclosure relates to an electronic device for shoe and clothing care with a separated space and a method for controlling the operation thereof.

Description of Related Art

In general, when going out of the house, clothing or shoes are highly likely to be exposed to various bacteria or viruses. In summer or the rainy season, moisture may seep into clothes or shoes, making them less comfortable to wear or causing an unpleasant odor. To solve this, preferably, it is to dry or wash clothes or shoes as soon as possible after returning home. However, frequent washing may accelerate damage to clothes or shoes.

Recently, expensive clothes or shoes using functional fabrics, such as Gore-Tex, which are difficult to wash or clean, are being produced. Due to changes in lifestyle, the demand for products that dry, deodorize and sterilize clothes or shoes is steadily increasing.

SUMMARY

In general, shoe or clothing care home appliances have a shape of a hard case closet. The inside of the home appliance may have a structure capable of dehumidifying, deodorizing, or sterilizing loaded clothes or shoes by hot air, cold air, or steam.

A home appliance used for drying and deodorizing clothes may come up with a separate shoe sterilizer for shoe care. Recent home appliances provide a function for care of both clothes and shoes together, but care of both clothes and shoes may cause sanitary issues. For shoe care, the product needs to be installed close to the entrance for easier use and is thus required to be downsized.

An embodiment of the disclosure provides an electronic device for controlling a flow path according to deodorization, dehumidification, or sterilization of clothes or shoes by applying a separated chamber structure, and an operation method thereof.

According to an embodiment of the disclosure, an electronic device may comprise a housing, an upper chamber inside the housing, a lower chamber inside the housing, an upper machine room between a lower surface of the upper chamber and an upper surface of the lower chamber, an upper fan motor in the upper machine room, a lower machine room between a lower surface of the lower chamber and a bottom of the housing, a heat pump in the lower machine room, a first duct formed to allow a flow path from the upper machine room through to an upper portion of the upper chamber, and a second duct formed to allow a flow path from the lower machine room through to the upper machine room.

According to an embodiment of the disclosure, an electronic device may comprise an intake damper which forms a passage for introducing external air, an exhaust damper which forms a passage for discharging internal air, an upper fan motor in an upper machine room between a lower surface of an upper chamber inside a housing and an upper surface of a lower chamber inside the housing, a heat pump in a lower machine room between a lower surface of the lower chamber and a bottom of the housing, and a processor configured to control driving of the intake damper, the exhaust damper, the upper fan motor, or the heat pump. The processor may control the intake damper to block the external air from being introduced and control the exhaust damper to block the internal air from being discharged while the electronic device operates in a deodorization mode, and control the intake damper to introduce the external air and control the exhaust damper to discharge the internal air while the electronic device operates in a dehumidification mode.

According to an embodiment of the disclosure, an electronic device may comprise an upper fan motor in an upper machine room between a lower surface of an upper chamber inside a housing and an upper surface of a lower chamber inside the housing, a heat pump in a lower machine room between a lower surface of the lower chamber and a bottom of the housing, an internal damper to open and close a connection passage between a first duct in the upper chamber and a second duct disposed in the lower chamber, and a processor configured to control driving of the upper fan motor, the heat pump, or the internal damper. The processor may control the internal damper to close the connection passage between the first duct and the second duct in while the electronic device operates a deodorization mode and control the internal damper to open the connection passage between the first duct and the second duct for a preset time and, after the preset time elapses, controls the internal damper to close the connection passage between the first duct and the second duct, while the electronic device operates in a dehumidification mode.

According to an embodiment of the disclosure, a method for operating an electronic device having a housing in which an upper chamber and a lower chamber are separated may comprise controlling a damper to block external air from being introduced into the upper chamber or controlling the damper to block discharge of internal air from the upper chamber while the electronic device operates in a deodorization mode, controlling an upper fan motor and a lower heat pump to independently allow a flow path to be formed whereby the internal air is circulated in the upper chamber and the lower chamber, while the electronic device operates in the deodorization mode, controlling the damper to introduce the external air into the upper chamber and discharge the internal air from the upper chamber while the electronic device operates in a dehumidification mode, and controlling the upper fan motor and the lower heat pump to allow a flow path to be formed whereby the external air is circulated in the upper chamber and a flow path where the internal air is circulated in the lower chamber while the electronic device operates in the dehumidification mode.

According to an embodiment in the disclosure, a method for operating an electronic device having a housing in which an upper chamber and a lower chamber are separated may comprise controlling an internal damper to block a connection passage between a first duct in the upper chamber and a second duct in the lower chamber while the electronic device operates in a deodorization mode, controlling the internal damper to open the connection passage between the first duct and the second duct for a preset time while the electronic device operates in a dehumidification mode, and controlling the internal damper to close the connection passage between the first duct and the second duct after the preset time elapses.

According to an embodiment of the disclosure, the electronic device may increase consumer satisfaction by providing a suitable deodorizing, dehumidifying, or sterilizing environment considering the type of the target object to be cared for. Further, space utilization may be enhanced by placing a fan motor between the upper chamber and the lower chamber in the space separated structure.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION OF EXEMPLARY EMBODIMENTS

Hereinafter, the present invention is described in detail with reference to the accompanying drawings. In the following description, specific details, such as detailed configurations and components, will be provided merely for a better understanding of embodiments of the disclosure. Accordingly, it should be apparent to one of ordinary skill in the art that various changes and modifications may be made to the embodiments described herein without departing from the scope and spirit of the disclosure. Further, no description is made of well-known functions and configurations for clarity and brevity.

Figure 1:
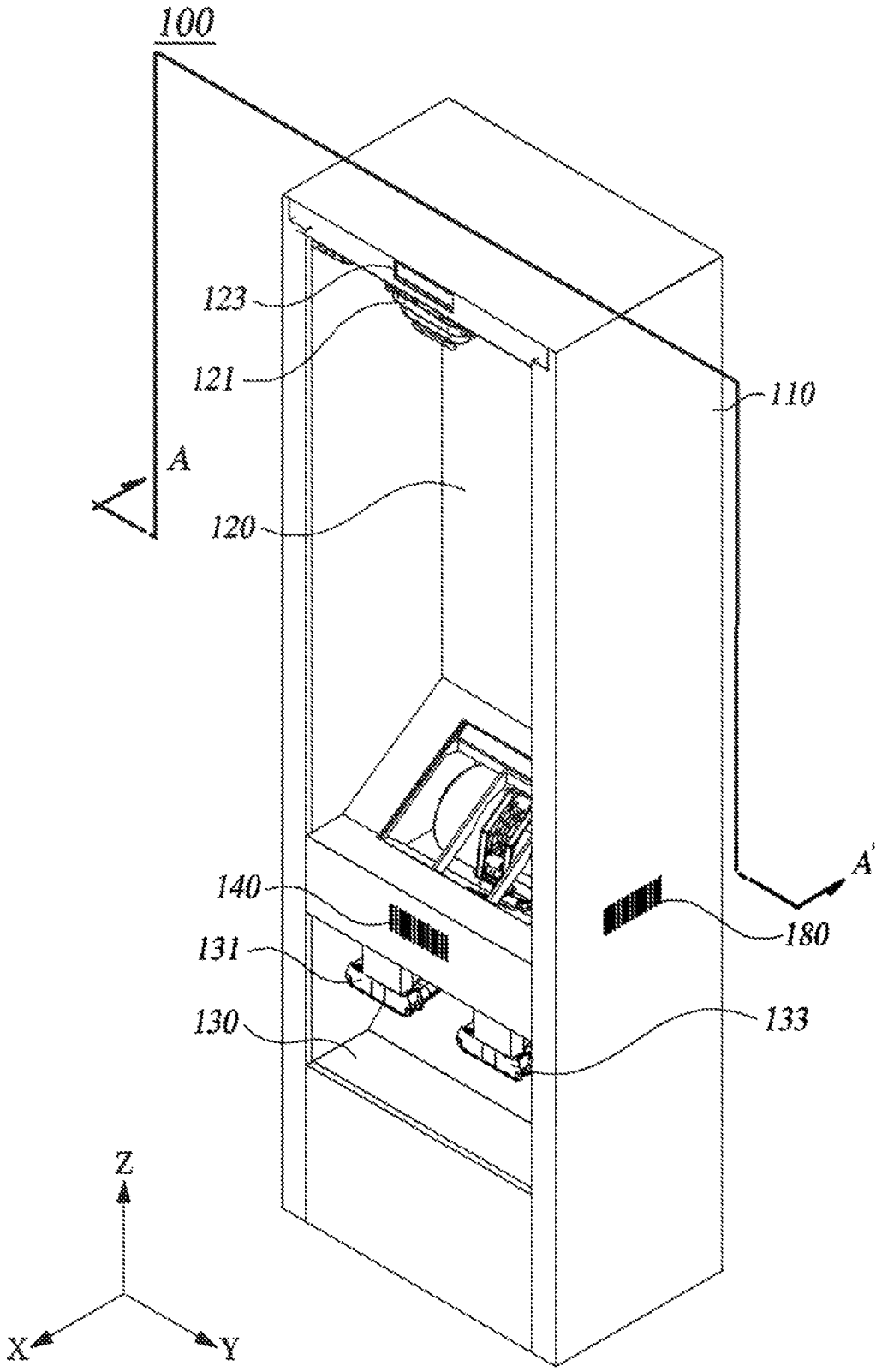
FIG. 1 is a perspective view illustrating an electronic device for caring for clothes and shoes according to an embodiment.
Figure 3:
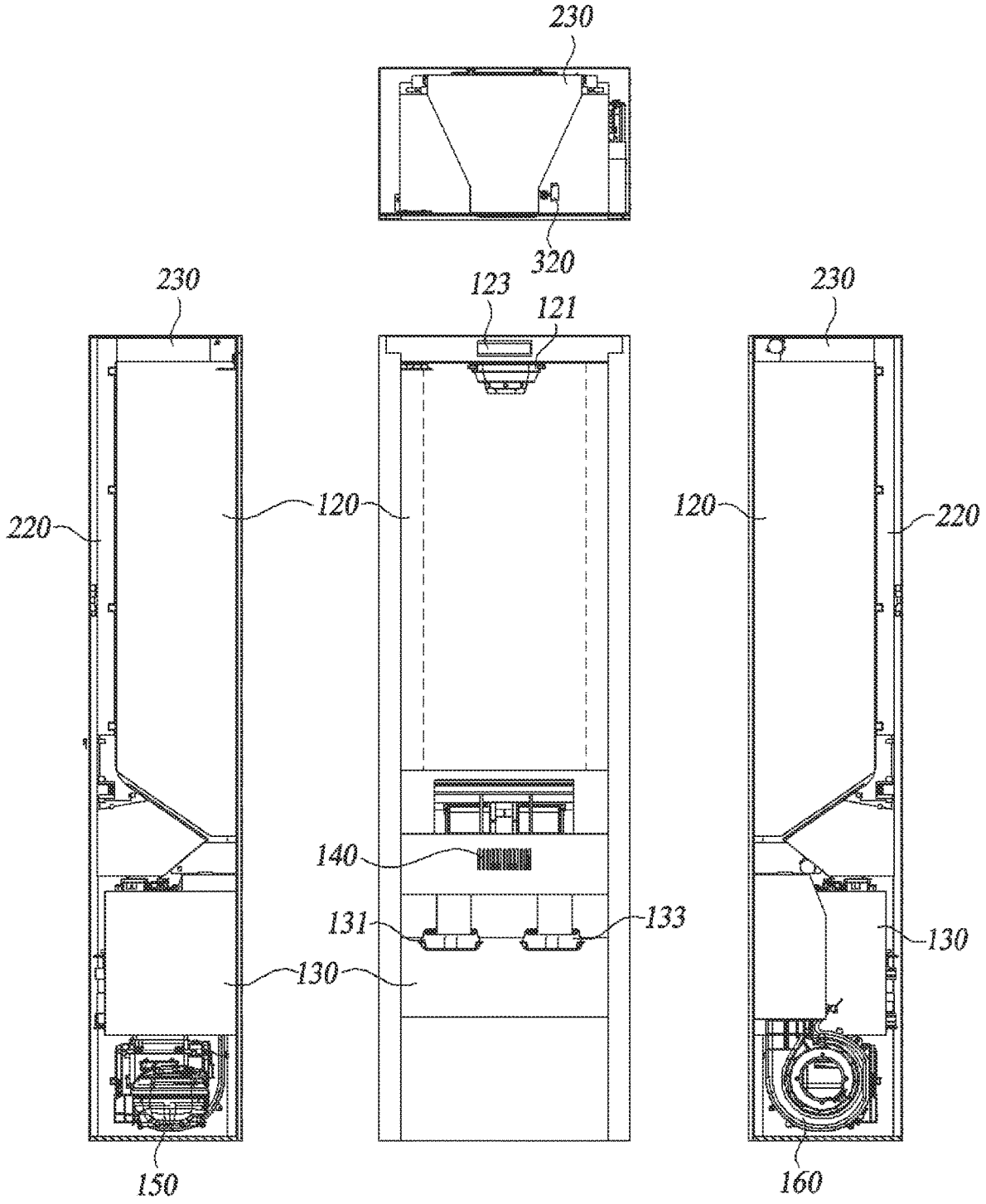
FIG. 3 illustrates a front, left/right, and top view of an electronic device for caring clothes and shoes according to an embodiment.

FIG. 1 is a perspective view illustrating an electronic device 100 for caring for clothes and shoes according to an embodiment. FIG. 3 illustrates a front, left/right, and top view of an electronic device 100 for caring clothes and shoes according to an embodiment.

Referring to FIGS. 1 and 3, a housing 110 of an electronic device 100 may include an upper chamber 120, a lower chamber 130, a first space provided above a ceiling (e.g., an upper surface) of the upper chamber 120, a second space provided between the upper chamber 120 and the lower chamber 130 or a third space provided below a bottom of the lower chamber 130. The second space may be used as, e.g., an upper machine room provided between the lower surface of the upper chamber 120 and the upper surface of the lower chamber 130. An upper fan motor may be disposed in the upper machine room. The third space may be used as, e.g., a lower machine room provided between the lower surface of the lower chamber 130 and the bottom of the housing 110. A heat pump may be disposed in the lower machine room.

According to an embodiment, an upper duct may be disposed in the upper chamber 120 to form a flow path connected from the second space, which may be used as the upper machine room, to the upper portion of the upper chamber 120. The upper duct may have a structure in which a first duct 220 disposed on the rear surface of the upper chamber 120 and a second duct 230 disposed on the upper surface of the upper chamber 120 are combined.

According to an embodiment, a lower duct (e.g., the lower duct 210 of FIG. 2) may be disposed on two opposite side surfaces of the lower chamber 130 to form a flow path from the third space, which may be used for the lower machine room, to the upper portion of the lower chamber 130.

According to an embodiment, a coupling member 121 may be provided at an upper end of the upper chamber 120. The coupling member 121 may have a structure capable of selectively coupling a shoe mount for shoes or a clothes mount for clothes. The lower end of the coupling member 121 may have, e.g., an opening opened downward.

According to an embodiment, the first space provided above the ceiling of the upper chamber 120 may communicate with the outside through a first opening 123 opened in the front direction (X-axis direction). The first opening 123 may be a passage for discharging the internal air to the outside. The first opening 123 may be provided to face the open outlet of the upper duct 230 disposed in the first space. An exhaust damper and a motor 320 for driving the exhaust damper may be disposed between the first opening 123 and the upper duct 230 facing each other. When the exhaust damper is opened by the driving of the motor 320, the outlet of the upper duct 230 may be opened to the outside. When closed by the driving of the motor 320, the outlet of the upper duct 230 may be blocked from the outside. When blocked from the outside by the exhaust damper, the air discharged through the outlet of the upper duct 230 may be blown out through the opening opened downward from the lower surface of the coupling member 121.

According to an embodiment, the first duct 220 may be disposed in a vertical direction between the rear surface of the upper chamber 120 and the housing 110. The second duct 230 may be disposed in a horizontal direction between the upper surface of the upper chamber 120 and the housing 110. The first duct 220 may have, e.g., a rectangular shape elongated in the vertical direction while having a predetermined horizontal width when viewed from the front. The second duct 230 may have, e.g., a circular sector shape with a wide end coupled with the first duct 220 and a narrow end coupled with the first opening 123.

According to an embodiment, a storage box (not shown) for storing a deodorizing material in an arbitrary position may be disposed in the first duct 220. The storage box may have a structure in which an internal flow path may be created not to obstruct the flow of air flowing through the first duct 220. The deodorizing material may be, e.g., a material capable of removing odors, such as charcoal. The storage box may be disposed in the upper duct 230 instead of the first duct 220.

According to an embodiment, shoe mounts 131 and 133 for mounting shoes may be provided at the upper end of the lower chamber 130. The shoe mounts 131 and 133 may have a structure capable of attaching and detaching shoes in front and rear directions. The inside of the shoe mounts 131 and 133 may have a hollow structure. The shoe mounts 131 and 133 having the hollow structure may have a second opening partially formed in the lower end thereof. The internal passage and the second openings of the shoe mounts 131 and 133 may eject the air, supplied through the flow path formed in the lower chamber 130, in the downward direction.

According to an embodiment, the second space provided between the upper chamber 120 and the lower chamber 130 may have a third opening 140 penetrating and opened in the front direction (X-axis direction). The third opening 140 may be a passage through which the second space communicates with the outside. For example, the third opening 140 may be a passage for discharging the internal air to the outside or sucking the external air into the inside. The second space may communicate with the outside through fourth openings 180 passing through the two opposite side surfaces of the housing 110 and opened in the side directions (Y-axis direction). The fourth openings 180 may be passages for sucking external air inward. The second space may be used as the upper machine room in which an upper fan motor (e.g., the upper fan motor 170 of FIG. 2) is to be disposed.

According to an embodiment, a third space to be used as a lower machine room may be provided under the bottom of the lower chamber 130. A heat pump capable of generating hot air may be disposed in the third space. The heat pump may include a heater 150 capable of generating heat and a lower fan motor 160 capable of generating wind. A duct in which a flow path through which the hot air generated by the heat pump 150 and 160 flows may be provided between the left side or right side of the lower chamber 130 and the housing.

Figure 2:
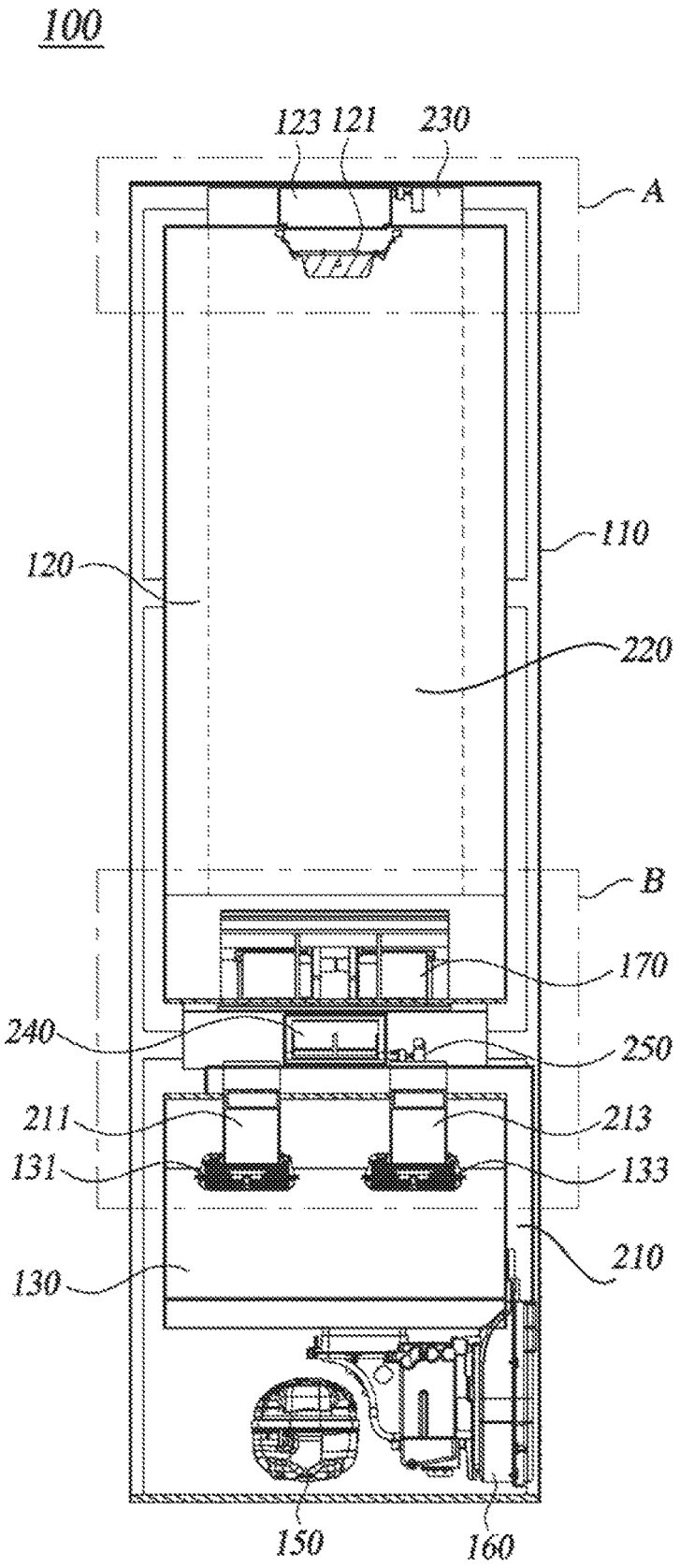
FIG. 2 is a cross-sectional view illustrating an electronic device for caring for clothes and shoes according to an embodiment.
Figure 4:
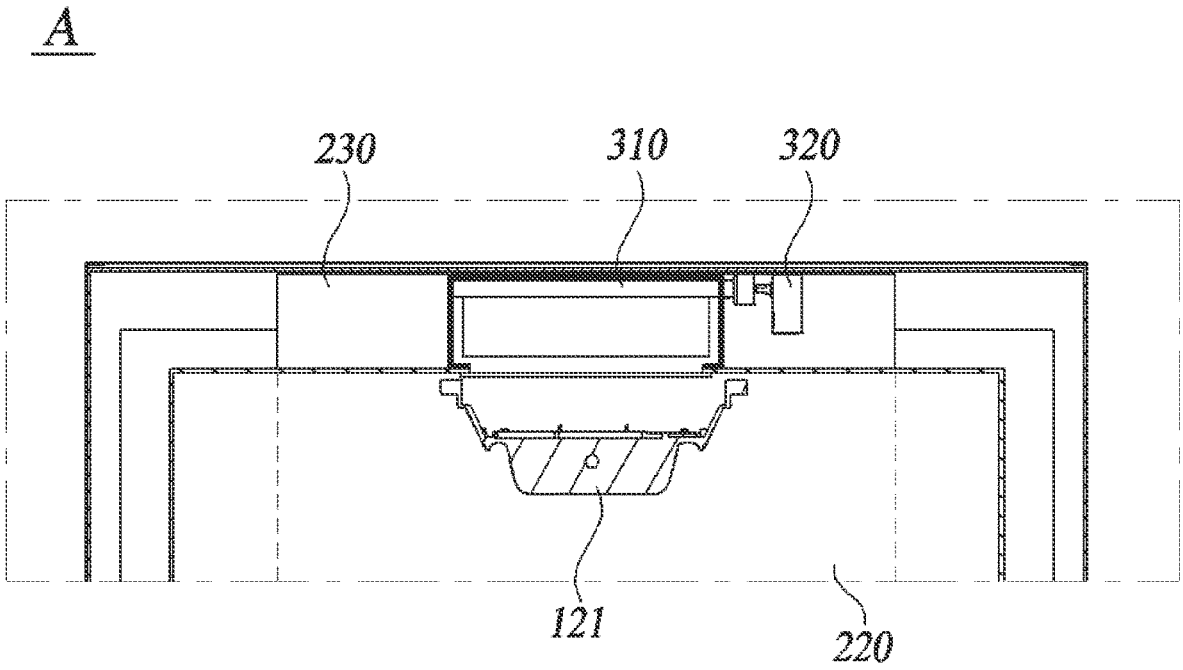
FIG. 4 is a detailed cross-sectional view of part A of FIG. 2 according to an embodiment.
Figure 5:
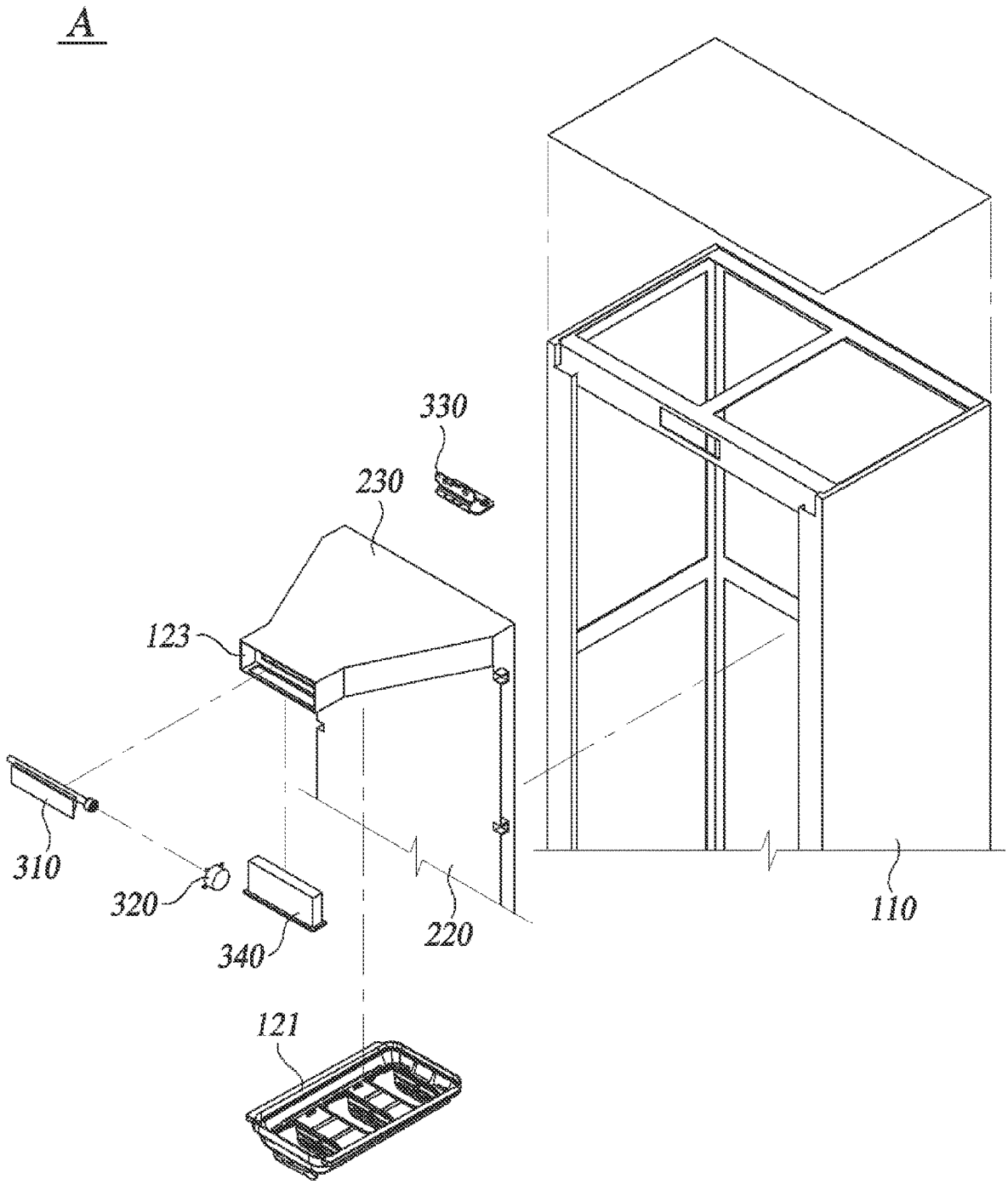
FIG. 5 is an exploded perspective view of part A of FIG. 2 according to an embodiment.
Figure 6:
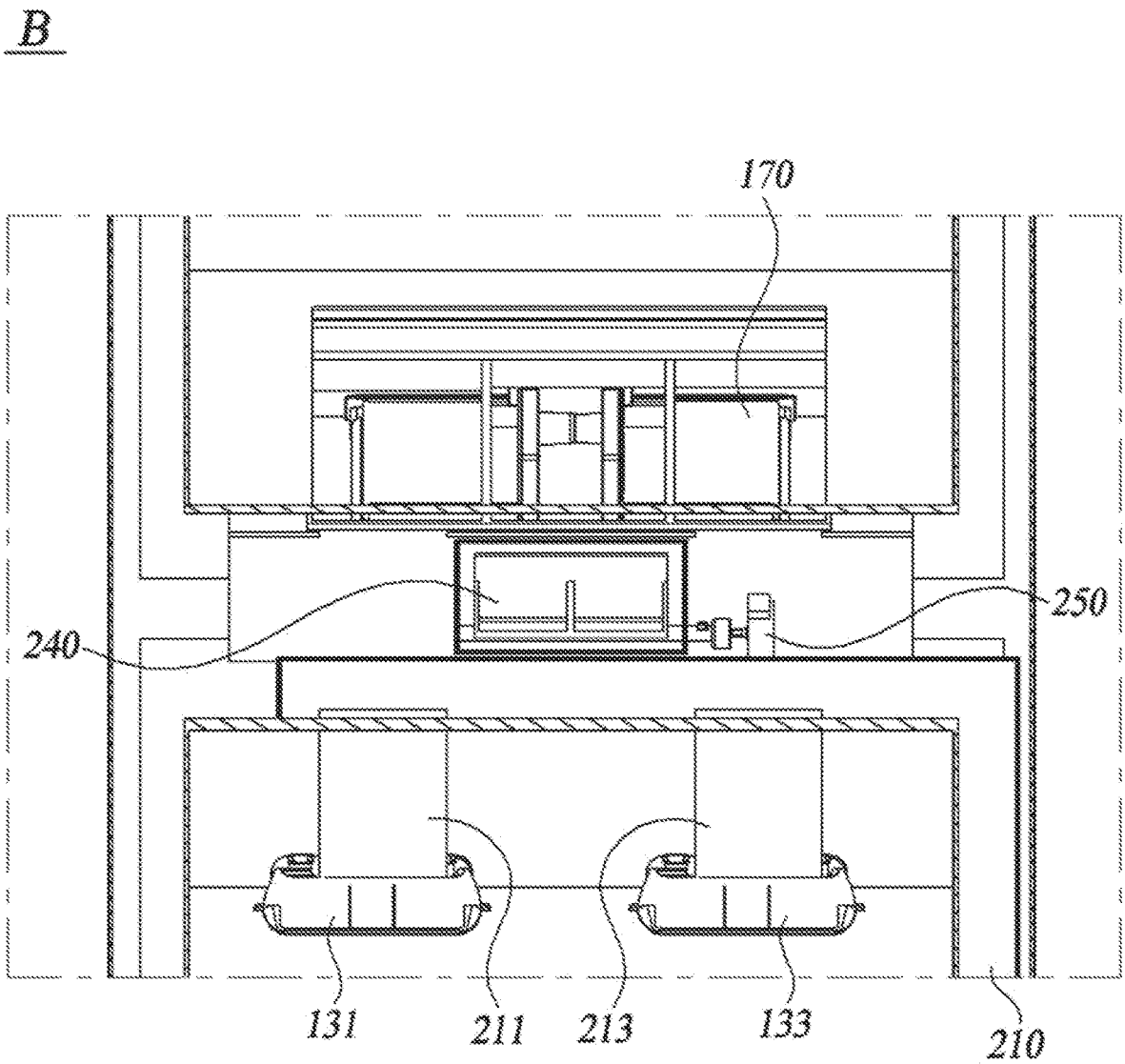
FIG. 6 is a detailed cross-sectional view of part B of FIG. 2 according to an embodiment.

FIG. 2 is a cross-sectional view A-A' illustrating an electronic device 100 for caring for clothes and shoes according to an embodiment. FIG. 4 is a detailed cross-sectional view of part A of FIG. 2. FIG. 5 is an exploded perspective view of part A of FIG. 2. FIG. 6 is a detailed cross-sectional view of part B of FIG. 2.

Referring to FIGS. 2 and 4 to 6, the inner space of the housing 110 of the electronic device 100 may be separated by the upper chamber 120 and the lower chamber 130. The upper chamber 120 may selectively mount clothes or shoes to deodorize, dehumidify, or sterilize. The lower chamber 130 may mount shoes to deodorize, dehumidify, or sterilize. A first space may be provided above the ceiling of the upper chamber 120. An exhaust damper 310, a first motor 320, and an upper duct 230 may be disposed in the first space. The exhaust damper 310 may control air exhaust in the forward direction through the first opening 123. The first motor 320 may drive the exhaust damper 310. The upper duct 230 may be a part of the duct 220 provided on the rear surface of the upper chamber 120 to form a flow path.

According to an embodiment, the coupling member 121 may be provided at the upper end A of the upper chamber 120. The coupling member 121 faces the upper duct 230 disposed in the first space and may have a downwardly protruding structure. The coupling member 121 may have a structure capable of selectively coupling a shoe mount for shoes or a clothes mount for clothes. The lower end of the coupling member 121 may have an opening opened downward.

According to an embodiment, the outer frame of the upper chamber 120 may be coupled to the housing 110. The duct 220 may be coupled to the opening formed in the upper frame of the outer frame to contact the outlet formed in one end of the upper duct 230. The upper duct 230 included in the duct 220 may be fastened to the outer frame of the upper chamber 120 by a fastening component 330. The first damper 310 may be fitted and coupled between the opening formed in the upper frame of the outer frame and the outlet formed in one end of the upper duct 230. The first motor 320 providing rotational driving of the first damper 310 may be coupled to one end of the first damper 310. The coupling member 121 may be coupled to be in tight contact with the lower surface of the upper duct 230. One open side surface of the coupling duct 340 may contact and couple to the opening formed in the lower surface of the upper duct 230. The other open side surface of the coupling duct 340 may contact and couple to the opening formed in the lower surface of the coupling member 121.

According to an embodiment, an upper fan motor 170 for generating air to be supplied to the upper chamber 120 may be disposed in a space provided under the bottom of the upper chamber 120. The lower duct 210 may be disposed in a right angle shape along one side surface and the upper surface of the lower chamber 130. An upper duct portion of the lower duct 210, facing the upper surface of the lower chamber 130, may form openings in at least two areas of the lower surface and may form an opening in at least one area of the upper surface. At least one opening formed in the upper surface of the upper duct portion may be coupled to one passage provided in the internal damper 240. The open ends of the coupling ducts 211 and 213 may be fitted and fastened to the openings formed in at least two areas formed in the lower surface of the upper duct portion. The other open ends of the coupling ducts 211 and 213 may be fitted to the upper surfaces of the shoe mounts 131 and 133. The shoe holders 131 and 133 have a hollow structure and may thus have an internal passage through which air may flow. Open holes or open surfaces for opening the internal passages downward may be formed in the lower surfaces of the shoe mounts 131 and 133. The internal damper 240 may be driven to rotate by the second motor 250. The internal damper 240 may, e.g., open or close the lower duct 210 to/from the upper chamber 120. When the lower duct 210 is opened to the upper chamber 120 by driving the internal damper 240, the flow path through the lower duct 210 may extend to the upper chamber 120.

Figure 7:
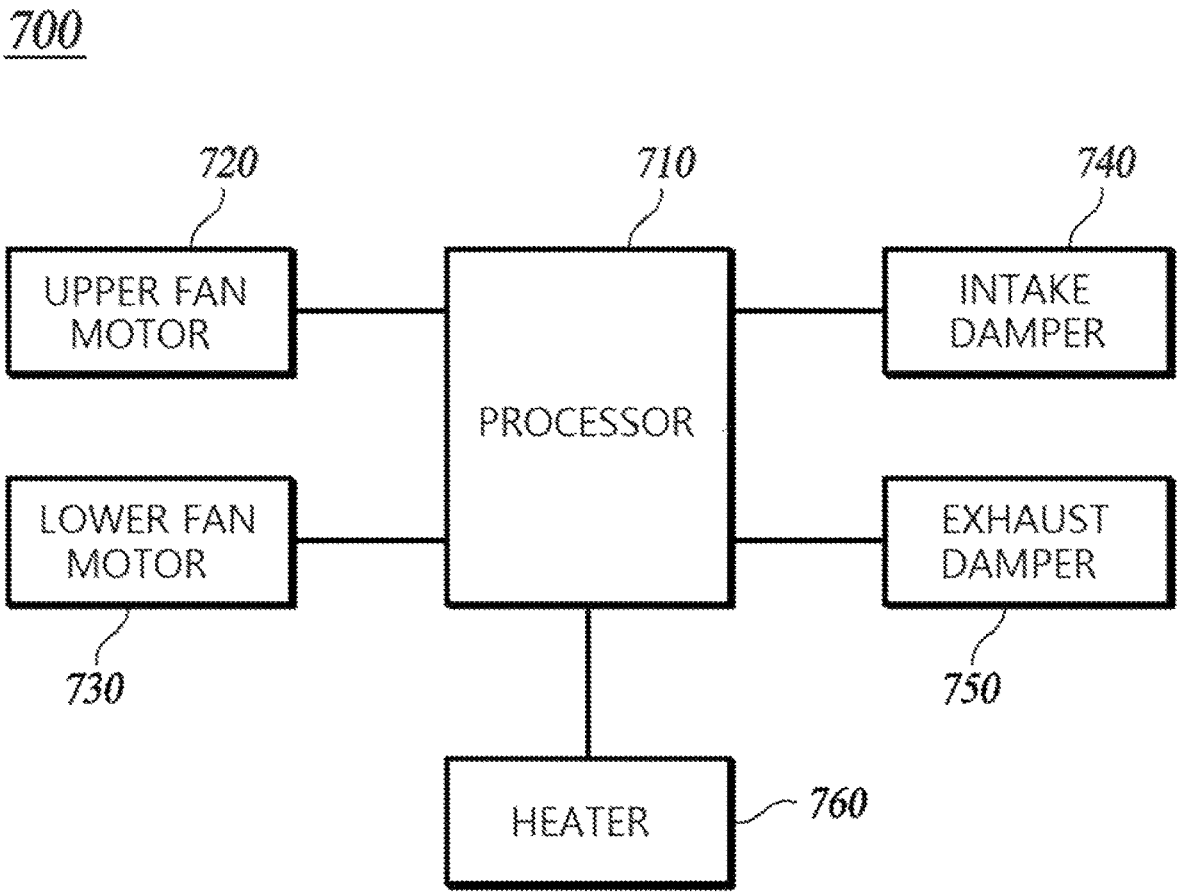
FIG. 7 is a block diagram illustrating an electronic device for caring for clothes and shoes according to an embodiment.

FIG. 7 is a block diagram illustrating an electronic device 700 for caring for clothes and shoes according to an embodiment.

Referring to FIG. 7, the electronic device 700 may include an upper fan motor 720, a lower fan motor 730, an intake damper 740, an exhaust damper 750, a heater 760, or a processor 710. The processor 710 may be electrically connected to the upper fan motor 720, the lower fan motor 730, the intake damper 740, the exhaust damper 750, or the heater 760. The heater 760 may be a heat pump (e.g., the heater 150 and the lower fan motor 160) as shown in FIGS. 2 and 3.

According to an embodiment, the upper fan motor 720 may be disposed in the space below the bottom of the upper chamber (e.g., the upper chamber 120 of FIG. 1) that spatially separates the housing. When the upper fan motor 720 is disposed in a space secured between the upper chamber 120 and the lower chamber (e.g., the lower chamber 130 of FIG. 1), the installation space of the electronic device 700 may be reduced. When driven, the upper fan motor 720 may create an air flow, forming a flow path in the upper chamber 120.

According to an embodiment, the lower fan motor 730 may be disposed in the space below the bottom of the lower chamber 130 that spatially separates the housing. As the lower fan motor 730 is disposed in the direction perpendicular to the lower chamber 130, the horizontal width of the electronic device 700 may be reduced. When driven, the lower fan motor 730 may generate a flow of air to form a flow path in the lower chamber 130 or, when the lower chamber 130 and the upper chamber 120 are opened, form a single flow path overall in the lower chamber 130 and the upper chamber 120.

According to an embodiment, the intake damper 740 may be closed in the deodorization mode to block external air from being sucked into the inside and, in the dehumidification mode, be opened to allow the external air to be sucked into the inside. The intake damper 740 may be installed on at least one of the left/right side surfaces of the housing, which corresponds to a middle between the upper chamber 120 and the lower chamber 130 which spatially separate the housing.

According to an embodiment, the exhaust damper 750 may be closed in the deodorization mode to block the internal air from being discharged to the outside and, in the dehumidification mode, be opened to discharge the internal air to the outside. The exhaust damper 750 may be disposed so that the opening provided in the upper end of the upper chamber 120 spatially separates the housing to discharge the external air is opened/closed.

According to an embodiment, the heater 760 may be driven so that heat may be applied to both the upper chamber 120 and the lower chamber 130 when operated in the deodorization mode and be driven so that heat may be applied to the lower chamber 130 where the shoes may be mounted when operated in the dehumidification mode. For example, the temperature appropriate for the deodorizing mode and the dehumidification mode may be different (e.g., 50 degrees or more for clothes, 40 degrees or less for shoes) depending on the clothes and shoes. In this case, due to the structure in which the upper chamber 120 and the lower chamber 130 are separated, it may be easy to maintain an optimized care temperature. When operated in the sterilization mode, the upper chamber 120 may be sterilized at a high temperature (e.g., 60 degrees or more) by the heat generated by the heater 760, and the lower chamber 130 may be sterilized through a ultraviolet-C (UVC) device near a shoe tree.

According to an embodiment, the processor 710 may form an independent internal flow path in each of the upper chamber 120 and the lower chamber 130. The processor 710 may perform control to deodorize the shoes and/or clothes using the heat generated by the heater 760 and/or a UV filter. The internal flow path may be a flow path created to circulate only internal air without introducing external air. The internal flow path may be created, e.g., by driving the upper fan motor 720 and the lower fan motor 730 after blocking discharge of the internal air to the outside or introduction of the external air into the inside by closing both the intake damper 740 and the exhaust damper 750.

According to an embodiment, the processor 710 may control to form an external flow path in the upper chamber 120 and dehumidify the clothes and/or shoes by using the external air circulating through the external flow path. The processor 710 may control to form an internal flow path in the lower chamber 130 to dehumidify the shoes using the heat generated by the heater 760 and/or a UV filter. The external flow path may be a flow path in which external air is introduced, circulates through the duct (e.g., the duct 220 of FIG. 2) provided in the upper chamber 120, and is then exhausted to the outside. The processor 710 may control, e.g., to open both the intake damper 740 and the exhaust damper 750 to introduce the external air into the inside through the external flow path and to discharge the internal air, circulated through the duct 220 provided in the upper chamber 120, to the outside. In this case, the processor 710 may control to drive the upper and lower fan motors 720 and 730 and not to drive the heater 760.

According to an embodiment, the processor 710 may control the internal damper to open the upper chamber 120 and the lower chamber 130 for a predetermined to form one internal flow path. In this case, the processor 710 controls the heater 760 to generate heat to dehumidify the clothes mounted in the upper chamber 120 and/or the shoes mounted in the lower chamber 130. When the predetermined time elapses, the processor 710 may control the internal damper to spatially separate the upper chamber 120 and the lower chamber 130, forming independent internal flow paths. The processor 710 controls the heater 760 to generate heat to dehumidify the shoes mounted in the lower chamber 130.

Figure 8:
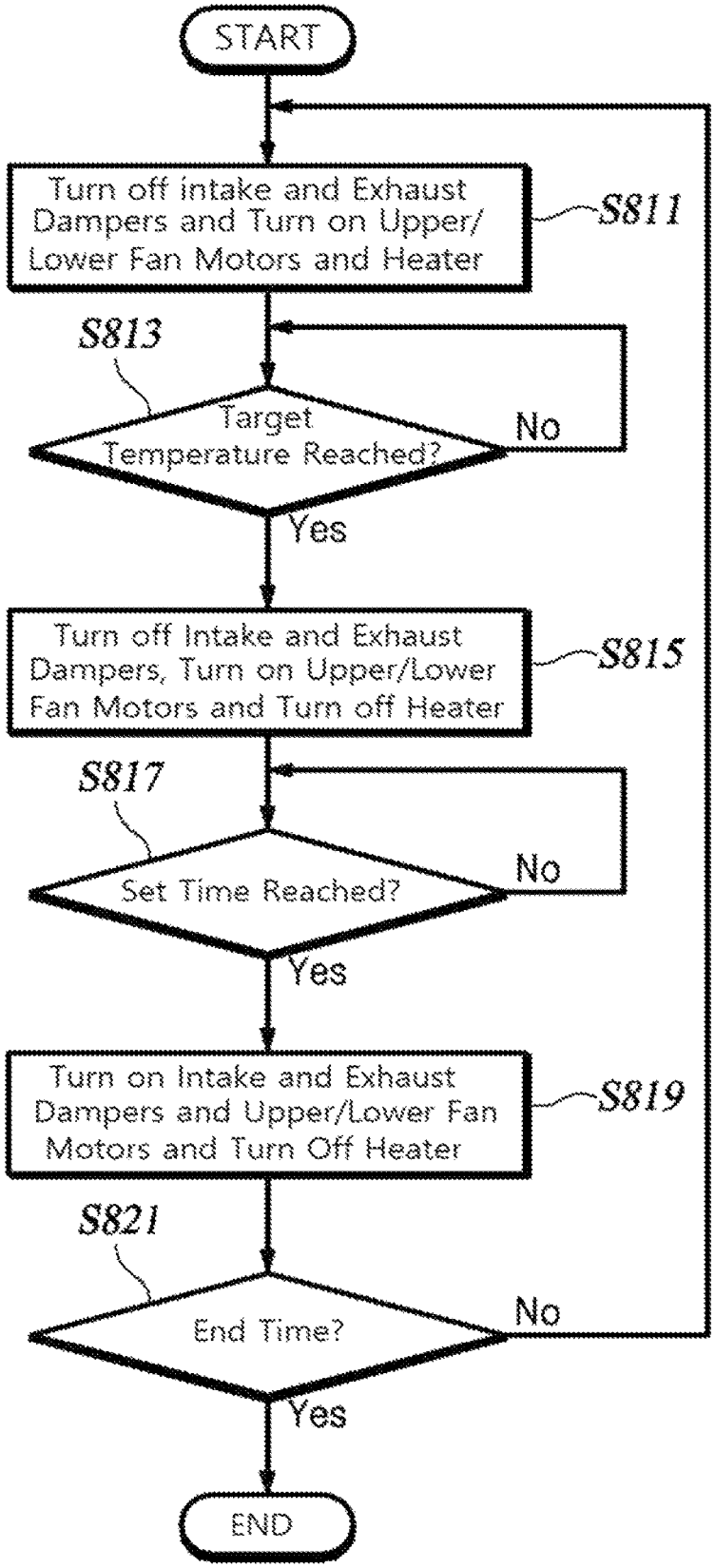
FIG. 8 is a flowchart illustrating a method for caring for clothes or shoes by an electronic device according to an embodiment.
Figure 9:
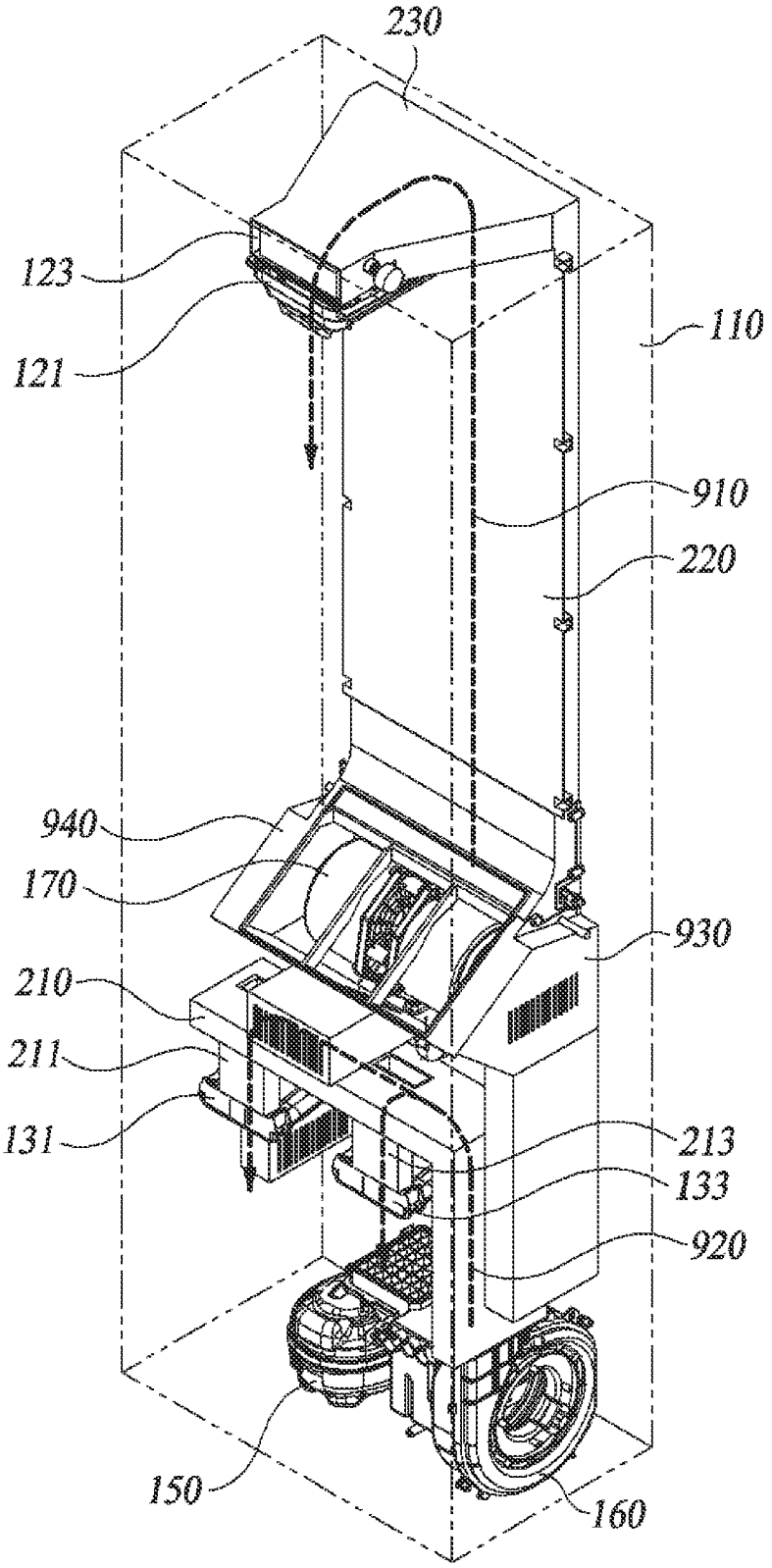
FIG. 9 is an exemplary view illustrating a flow path formed by an electronic device in a deodorization mode, according to an embodiment.
Figure 10:
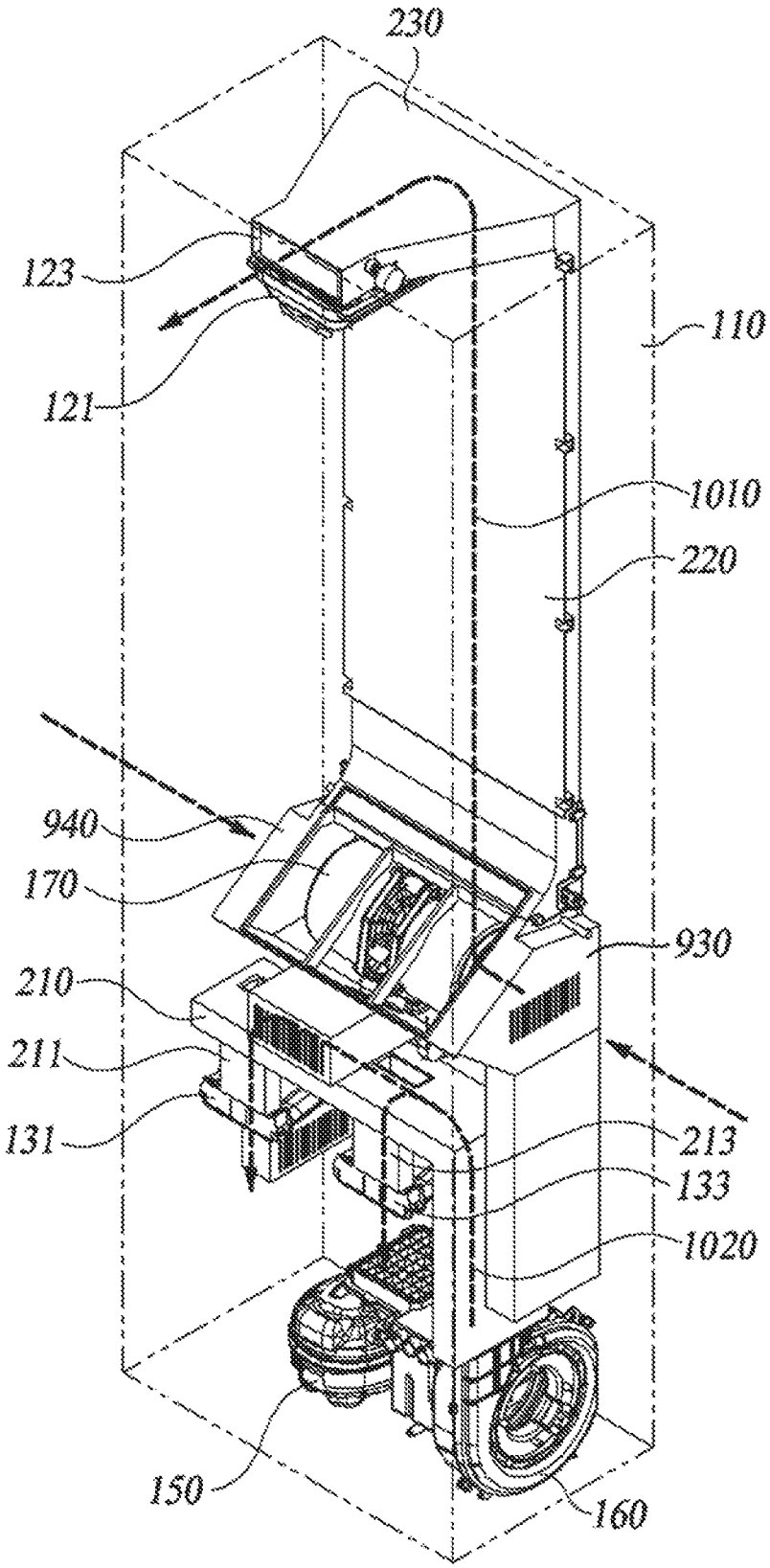
FIG. 10 is an exemplary view illustrating a flow path formed by an electronic device in a dehumidification mode, according to an embodiment.
Figure 11:
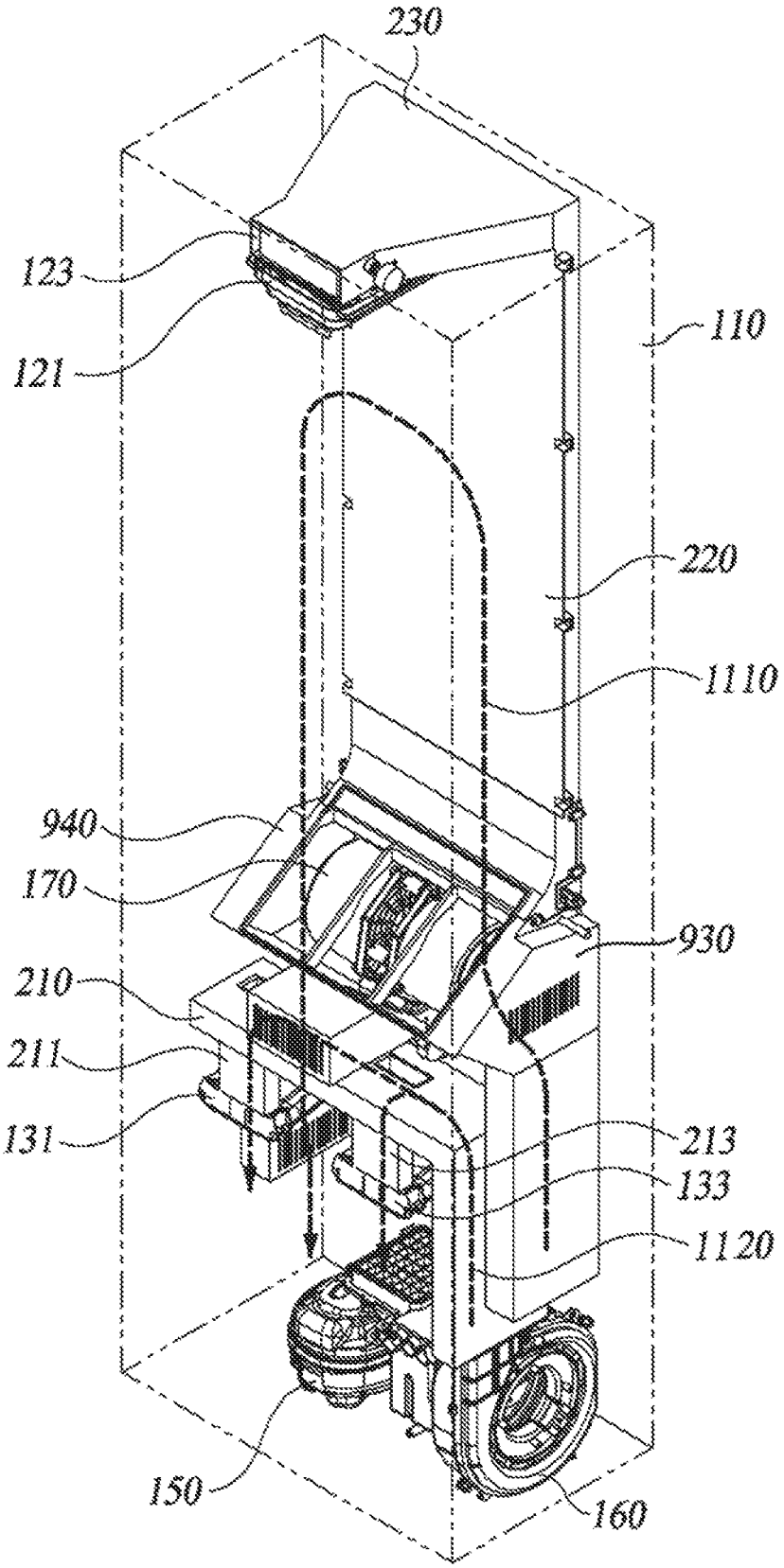
FIG. 11 is an exemplary view illustrating a flow path formed by an electronic device in a deodorization mode, according to an embodiment.

FIG. 8 is a flowchart illustrating a method for caring for clothes or shoes by an electronic device (e.g., the electronic device 700 of FIG. 7) according to an embodiment. FIG. 9 is an exemplary view illustrating a flow path formed by an electronic device 700 in a deodorization mode, according to an embodiment. FIG. 10 is an exemplary view illustrating a flow path formed by an electronic device 700 in a dehumidification mode, according to an embodiment. FIG. 11 is an exemplary view illustrating a flow path formed by an electronic device 700 in a deodorization mode, according to an embodiment.

Referring to FIGS. 8 to 11, the electronic device 700 may perform operations according to the deodorization mode in operations S811, S813, S815, and S817. The electronic device 700 may perform operations according to the dehumidification mode in operations S819 and S821.

According to an embodiment, in operations S811, S813, S815, and S817, the electronic device 700 may form independent flow paths (e.g., the first flow path 910 formed in the upper chamber 120 and the second flow path 920 formed in the lower chamber 130 in FIG. 9) in the upper chamber (e.g., the upper chamber 120 of FIG. 1) and the lower chamber (e.g., the lower chamber 130 of FIG. 1), respectively. The electronic device 700 may deodorize the clothes and/or shoes using the heat generated by the heater (e.g., the heat pump (e.g., the heater 150 and lower fan motor 160 of FIGS. 2 and 3) or the heater 760 of FIG. 7) until a target temperature is reached and/or by a UV filter. The internal flow paths 910 and 920 may be flow paths created to circulate only internal air without introducing external air. The internal flow paths 910 and 920 may be created, e.g., by driving the fan motor (e.g., the upper fan motor 720 and lower fan motor 730 of FIG. 7 or the upper fan motor 170 and lower fan motor 160 of FIG. 9) after blocking discharge of the internal air to the outside or introduction of the external air into the inside by closing both the intake damper (e.g., the intake damper 740 of FIG. 7 or the left intake damper 940 and right intake damper 930 of FIG. 9) and the exhaust damper (e.g., the exhaust damper 750 of FIG. 7 or the upper damper 123 of FIG. 9).

In FIG. 9, e.g., the wind generated by the driving of the upper fan motor 170 disposed in the space below the bottom of the upper chamber 120 may form the first path 910 through the rear duct 220 provided between the rear surface of the upper chamber 120 and the housing 110 to the upper duct 230 provided between the upper surface of the upper chamber 120 and the housing 110. Since the upper damper 123, which is an exhaust damper disposed in the front direction of the upper duct 230, is closed, the first flow path may be formed in the downward direction through the opening of the coupling member 121 capable of coupling the clothes mount or shoe mount from the upper duct 230. The clothes or shoes mounted on the coupling member 121 may be deodorized by removing an unpleasant odor with the wind blowing through the opening.

In FIG. 9, e.g., the wind generated by the driving of the lower fan motor 160 disposed in the space below the bottom of the lower chamber 130 may form the second flow path 920 in the downward direction through the openings of the shoes mounts 131 and 133 provided at the upper end of the lower chamber 130 through the lower chamber duct 210. The lower chamber duct 210 may include, e.g., a side duct, upper duct, or coupling ducts 211 and 213. The side duct may be provided between, e.g., at least one of two opposite side surfaces of the lower chamber 130 and the housing 110. The upper duct may be provided, e.g., at an upper end of the lower chamber 130. The coupling ducts 211 and 213 may couple the respective first ends of the upper ducts to the inner passages of the shoe mounts 131 and 133. The unpleasant odor may be removed from the shoes mounted on the shoe mounts 131 and 133 by the wind blown downward through the openings of the shoe mounts 131 and 133.

According to an embodiment, the electronic device 700 may form an external flow path (e.g., the third flow path 1010 formed in the upper chamber 120 in FIG. 10) in the upper chamber 120 in operations S819 to S821. The electronic device 700 may use external air circulating through the external flow path to dehumidify clothes and/or shoes. The electronic device 700 may form, e.g., an internal flow path (e.g., the fourth flow path 1020 formed in the lower chamber 130 in FIG. 10) in the lower chamber 130, dehumidifying the shoes using the heat generated by the heater (e.g., the heater 760 of FIG. 7 or the heater 150 of FIG. 10) and/or a UV filter. The third flow path may be a flow path in which external air is introduced, circulates through the ducts 220 and 230 provided in the upper chamber 120, and is then exhausted to the outside. The third flow path 1010 may be formed, e.g., so that the intake damper 740 is opened to introduce the external air into the inside, and the exhaust dampers 123 and 750 are opened to discharge the air circulated through the duct 220 to the outside. In this case, the electronic device 700 may drive the fan motor 170 or 720 or 150 or 730 and may not drive the heater 160 or 760. The fourth flow path 1020 may be formed, e.g., through the duct provided in the lower chamber 130 by driving the fan motor (e.g., the lower fan motor 730 of FIG. 7 or the lower fan motor 160 of FIG. 10).

Referring to FIG. 10, the driving of the upper fan motor 170 disposed in the space below the bottom of the upper chamber 120 may form the third flow path 1010. The third flow path 1010 may be formed so that the external air sucked by the right intake damper 930 and left intake damper 940 provided on two opposite side surfaces of the upper chamber 120 flows through the rear duct 220 to the upper duct 230 provided between the upper surface of the upper chamber 120 and the housing 110. Since the upper damper 123, which is an exhaust damper disposed in the front direction of the upper duct 230, is opened, the third flow path 1010 may be formed so that the air is discharged to the outside through the upper damper 123, not through the opening of the coupling member 121 capable of coupling the clothes mount or shoe mount from the upper duct 230.

For example, the driving of the lower fan motor 160 disposed in the space below the bottom of the lower chamber 130 may form the fourth flow path 1020. The fourth flow path 1020 may be formed downward through the openings of the shoe mounts 131 and 133 provided at the upper end of the lower chamber 130 through the lower chamber duct 210. The lower chamber duct 210 may include, e.g., a side duct, upper duct, or coupling ducts 211 and 213. The side duct may be provided between at least one of two opposite side surfaces of the lower chamber 130 and the housing 110. The upper duct may be provided at an upper end of the lower chamber 130. The coupling ducts 211 and 213 may couple the respective first ends of the upper ducts to the inner passages of the shoe mounts 131 and 133. The unpleasant odor may be removed from the shoes mounted on the shoe mounts 131 and 133 by the wind blown downward through the openings of the shoe mounts 131 and 133.

According to an embodiment, in operations S819 to S821, during the predetermined time, the electronic device 700 may open the internal damper (e.g., the internal damper 240 of FIG. 2) connecting the upper chamber 120 and the lower chamber 130, forming one internal flow path (e.g., the fifth flow path 1110 formed to connect the lower chamber 130 and the upper chamber 120 in FIG. 11). When a UV filter is used, the clothes mounted in the upper chamber 120 and/or the shoes mounted in the lower chamber 130 may be dehumidified by the flow of air circulating along the fifth flow path 1110. If the predetermined time elapses, the electronic device 700 may close the internal damper 240 to separate the upper chamber 120 and the lower chamber 130. In this case, an independent internal flow path (e.g., the sixth flow path 1120 formed in the lower chamber 130 in FIG. 11) may be formed. Dehumidification of the shoes mounted in the lower chamber 130 may be performed using the UV filter. The electronic device 700 may drive the heater 150 as necessary. The heat generated by the operation of the heater 150 may increase the temperature of the air flowing through the fifth flow path 1110 which is one internal flow path or the sixth flow path 1120 which is an independent internal flow path.

Referring to FIG. 11, according to an embodiment, during a preset first time period, the electronic device 700 may open the internal damper 240 so that the upper end of the upper chamber 120 and the lower end of the lower chamber 130 are mutually opened. In this case, the high-temperature wind generated by the operation of the lower fan motor 170 and the heater 150 disposed in the space below the bottom of the lower chamber 130 may be supplied along the fifth flow path 1110. The fifth flow path 1110 may be formed by, e.g., the side duct, rear duct 220, and upper duct 230. The side duct may be provided between, e.g., at least one of two opposite side surfaces of the lower chamber 130 and the housing 110. The rear duct 220 may be provided, e.g., between the rear surface of the upper chamber 120 and the housing 110. The upper duct 230 may be provided, e.g., between the upper surface of the upper chamber 120 and the housing 110. Since the upper damper 123, which is an exhaust damper disposed in the front direction of the upper duct 230, is closed, the fifth flow path 1110 may be formed to extend in the downward direction to be discharged through the opening of the coupling member 121 capable of coupling the clothes mount or shoe mount from the upper duct 230.

Referring to FIG. 11, according to an embodiment, if the preset first time period elapses, the electronic device 700 may close the internal damper 240 so that the upper end of the upper chamber 120 and the lower end of the lower chamber 130 are separated. In this case, the high-temperature wind generated by the operation of the lower fan motor 170 and the heater 150 disposed in the space below the bottom of the lower chamber 130 may form the sixth flow path 1120. For example, the sixth flow path 1120 may be formed downward through the openings of the shoe mounts 131 and 133 provided at the upper end of the lower chamber 130 through the lower chamber duct 210. The lower chamber duct 210 may include, e.g., a side duct, upper duct, and coupling ducts 211 and 213. The side duct may be provided between at least one of two opposite side surfaces of the lower chamber 130 and the housing 110. The upper duct may be provided at an upper end of the lower chamber 130. The coupling ducts 131 and 133 may couple the respective first ends of the upper ducts to the inner passages of the shoe mounts 131 and 133. The shoes mounted on the shoe mounts 131 and 133 may be dehumidified by the hot wind blown downward through the openings of the shoe mounts 131 and 133.

The threshold temperature set for the upper chamber 120 and the lower chamber 130 in the deodorization mode operated as described above may be different from the threshold temperature set for the upper chamber 120 and the lower chamber 130 in the dehumidification mode.

The above-described operations are described in detail with reference to FIG. 8. In operation S811, the electronic device 700 may turn off the intake damper 740 and the exhaust damper 750 to introduce external air or block exhaust of the internal air. The electronic device 700 may drive the fan motor (the upper fan motor 720 and the lower fan motor 730 of FIG. 7) to create an internal flow path. The electronic device 700 may operate the heater 760 to increase the temperature of the internal air circulated through the internal flow path. In this case, an independent internal flow path may be formed in each of the upper chamber 120 and the lower chamber 130. The hot internal air supplied through the independently formed internal flow path may be used to deodorize the clothes and/or shoes mounted in the upper chamber 120 and/or the lower chamber 130.

In operation S813, the electronic device 700 may check whether the internal temperature of the upper chamber 120 and/or the lower chamber 130 has reached a threshold temperature that is a target temperature that may be preset. The electronic device 700 may include a temperature sensor in the upper chamber 120 and/or the lower chamber 130 to check the temperature. Checking the internal temperature is to prevent damage to the mounted clothes and/or shoes due to an excessive increase in the internal temperature during the deodorization operation.

If the internal temperature of the upper chamber 120 and/or the lower chamber 130 reaches the target temperature that may be preset, in operation S815, the electronic device 700 may maintain the off state of the intake damper 740 and the exhaust damper 750 and keep driving the fan motors 720 and 730 to create an internal flow path. Since the temperature of the internal air circulated through the internal flow path rose to a predetermined level, the electronic device 700 may stop the operation of the heater 760. In this case, an independent internal flow path may be formed in each of the upper chamber 120 and the lower chamber 130. The clothes and/or shoes mounted in the upper chamber 120 and/or the lower chamber 130 may be deodorized by the internal air having a temperature lower than a preset target temperature and supplied through the independently formed internal flow path.

In operation S817, the electronic device 700 may determine whether a time preset for the deodorization mode has elapsed. The preset time may be a set time to perform the deodorization mode. Determining the lapse of the preset time may have the same meaning as, e.g., determining whether the time to turn on the intake damper 740 and the exhaust damper 50 has arrived.

When the time set for the deodorization mode elapses, in an embodiment, the electronic device 700 may turn on the intake damper 740 and the exhaust damper 750 in operation S819, allowing for introduction of external air or discharge of the internal air. The electronic device 700 may drive the fan motors 720 and 730 to create an external flow path in the upper chamber 120. Since the electronic device 700 does not need to increase the temperature of the external air to be circulated through the external flow path, the electronic device 700 may not operate the heater 760. In this case, an external flow path may be formed in the upper chamber 120, and an internal flow path may be formed in the lower chamber 130. The clothes and/or shoes mounted in the upper chamber 120 and/or the lower chamber 130 may be dehumidified by the external flow path and the internal flow path.

If the time set for the deodorization mode elapses, in an embodiment, the electronic device 700 may turn on the internal damper 240 and drive the fan motors 720 and 730 in operation S819 so that one internal flow path through which internal air may circulate between the upper chamber 120 and the lower chamber 130 may be created. The electronic device 700 may operate the heater 760 to increase the temperature of the internal air circulated through the created internal flow path. In this case, one internal flow path may be formed in the upper chamber 120 and the lower chamber 130. The hot internal air supplied through the one internal flow path may be used to dehumidify the clothes and/or shoes mounted in the upper chamber 120 and/or the lower chamber 130. If the time set to dehumidify the upper chamber 120 elapses, the electronic device 700 may turn off the internal damper 240 to create an independent internal flow path that allows for independent circulation of the internal air between the upper chamber 120 and the lower chamber 130. In this case, the dehumidification of the shoes mounted in the lower chamber 130 may be performed for a predetermined time.

In operation S821, the electronic device 700 may determine whether an end time to complete all of the operations for deodorization and dehumidification has reached. If the end time is reached, the electronic device 700 may terminate all the operations and, otherwise, return to operation S811 to repeat the above-described operations.

It should be appreciated that various embodiments of the present disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include all possible combinations of the items enumerated together in a corresponding one of the phrases. As used herein, such terms as "1st" and "2nd," or "first" and "second" may be used to simply distinguish a corresponding component from another, and does not limit the components in other aspect importance or order). It is to be understood that if an element (e.g., a first element) is referred to, with or without the term "operatively" or "communicatively", as "coupled with," "coupled to," "connected with," or "connected to" another element a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program) including one or more instructions that are stored in a storage medium (e.g., internal memory or external memory) that is readable by a machine (e.g., the electronic device 700). For example, a processor (e.g., the processor 710) of the machine (e.g., the electronic device 700) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program products may be traded as commodities between sellers and buyers. The computer program product may be distributed in the form of a machine-readable storage medium (e.g., compact disc read only memory (CD-ROM)), or be distributed (e.g., downloaded or uploaded) online via an application store (e.g., Play Store™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. Some of the plurality of entities may be separately disposed in different components. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

The invention claimed is:

1. An electronic device, comprising:

an intake damper configured to form a passage for inflowing external air;

an exhaust damper configured to form a passage for discharging internal air;

an upper fan motor disposed in an upper machine room located between an upper chamber and a lower chamber within a housing;

a heat pump disposed in a lower machine room located between the lower chamber and a floor of the housing; and a processor configured to control driving of at least one of the intake damper, the exhaust damper, the upper fan motor, or the heat pump, wherein the processor is configured to:

in response to operating in a deodorization mode, control the intake damper to block the inflow of the external air and control the exhaust damper to block the discharge of the internal air, and in response to operating in a dehumidification mode, control the intake damper to allow the inflow of the external air and control the exhaust damper to allow the discharge of the internal air.

2. The electronic device of claim 1, wherein the processor is configured to control the heat pump to maintain an internal temperature of the upper chamber and the lower chamber below a preset threshold temperature in the deodorization mode.

3. The electronic device of claim 1, wherein the processor is configured to control the heat pump to maintain an internal temperature of the upper chamber below a preset threshold temperature in a sterilization mode.

4. The electronic device of claim 1, wherein the processor is configured to control the heat pump to maintain an internal temperature of the upper chamber and the lower chamber below a preset threshold temperature in the dehumidification mode.

5. An electronic device, comprising:

an upper fan motor disposed in an upper machine room located between an upper chamber and a lower chamber within a housing;

a heat pump disposed in a lower machine room located between the lower chamber and a floor of the housing;

an internal damper configured to open and close a connection passage between a first duct in the upper chamber and a second duct in the lower chamber; and a processor configured to control driving of at least one of the upper fan motor, the heat pump, or the internal damper, wherein the processor is configured to:

in response to operating in a deodorization mode, control the internal damper to close the connection passage; and in response to operating in a dehumidification mode, control the internal damper to open the connection passage for a preset time and, after the preset time elapses, control the internal damper to close the connection passage.

6. The electronic device of claim 5, wherein the processor is configured to set a first threshold temperature of the upper chamber and the lower chamber in the deodorization mode to be different from a second threshold temperature of the upper chamber and the lower chamber in the dehumidification mode.

7. The electronic device of claim 5, wherein the processor is configured to, in response to operating in a sterilization mode, control the heat pump to maintain an internal temperature of the upper chamber below a preset threshold temperature.

* * * * *